US005413333A

United States Patent [19]

Janes et al.

[11] Patent Number: 5,413,333

[45] Date of Patent: May 9, 1995

[54] COLORED ADHESIVE FOR TENNIS BALL SEAMS AND A TENNIS BALL SEAM CONTAINING THE SAME

[75] Inventors: Richard Janes, Scottsdale; Louis J. Gagnon, Phoenix, both of Ariz.

[73] Assignee: GenCorp Inc., Fairlawn, Ohio

[21] Appl. No.: 163,977

[22] Filed: Dec. 8, 1993

[51] Int. Cl.[6] ..... A63B 39/00

[52] U.S. Cl. ..... 273/61 R

[58] Field of Search ..... 273/61 R, 61 C

[56] References Cited

U.S. PATENT DOCUMENTS 3,039,773 6/1962 Teegarden et al. ..... 273/61 R 4,853,056 8/1989 Hoffman ..... 273/61 R X

*Primary Examiner*—William H. Grieb

*Attorney, Agent, or Firm*—Robert F. Rywalski; Daniel J. Hudak

[57] ABSTRACT

A tennis ball is provided which has an elastomeric core and a cover having a seam. A colored seam adhesive bridges the seam and desirably matches the preferred yellowish color of the cover.

12 Claims, 1 Drawing Sheet

COLORED ADHESIVE FOR TENNIS BALL SEAMS AND A TENNIS BALL SEAM CONTAINING THE SAME

FIELD OF INVENTION

The invention generally relates to a colored adhesive and to tennis balls made using the adhesive. More specifically, the invention relates to a tennis ball seam adhesive which comprises a rubber adhesive containing organic pigments and/or dyes which enhance the ball visibility, desirably is color stable, and matches the cover color which preferably is optic yellow.

BACKGROUND OF THE INVENTION

Conventional tennis balls are generally fabricated from a pair of hemispherical shells which are made of an elastomeric material and which are bonded with an elastomeric adhesive to one another along their edges to form a hollow spherical core. The hemispherical shells which constitute the core of the ball are formed by compression molding or injection molding. The core halves are placed in a mold and cured in the presence of heat and pressure to form a unitary hollow sphere containing a gas at a pressure of typically from ambient to about fifteen psi above normal atmospheric pressure.

The core is then covered with a pair of felt panels which have been cut from a suitable felt material generally in the shape of a dog bone. The unitary hollow sphere can be dipped in a panel adhesive and the felt panels attached thereto. The backside of the felt panels can also have panel adhesive applied thereto before they are applied to the unitary hollow ball. A different and curable seam adhesive is applied to the edges of the felt panels as by stacking a plurality of felt panels with their edges aligned, mechanically compressing the panels with their edges exposed and repeated dipping them into a bath containing the seam adhesive until a suitable build-up has been achieved. Once the seam adhesive edge coat felt panels are applied to a ball, they are cured. Thus, the panels and the seam adhesive become an integral part of the core.

In an effort to improve the visibility of the ball, in the past the manufacturers adopted dyed felt. Prior to the present invention, the state of the art was represented by an optic yellow felt ball in which the felt panels were attached together by a non-fluorescent off-white rubber adhesive seam adhesive. These seams are generally about 0.125 inches thick, 12.375 inches long, and have a width between about 0.05 and 0.15 inches (representing about eight percent of the total surface area.) Thus, to the extent that the pigment represents a visual advantage, a unpigmented seam represents a visual opportunity loss.

SUMMARY OF THE INVENTION

The present invention relates to a tennis ball which has a pressurized rubber core, preferably optic yellow colored felt cover panels and a colored rubber adhesive as a seam material. In particular, the adhesive includes highly visible, colorants so that the seam desirably matches the color of the panels whereby the problem of improper placement of the seam adhesive relative to the felt panels is eliminated. Moreover, accidental overlap of the cement on the panel is difficult to notice. Thus, the present invention relates to a tennis ball having improved visibility and to a more efficient method of making tennis balls having reduced quality control rejections for cosmetic imperfections.

DETAILED DESCRIPTION OF THE INVENTION

Figure 1:
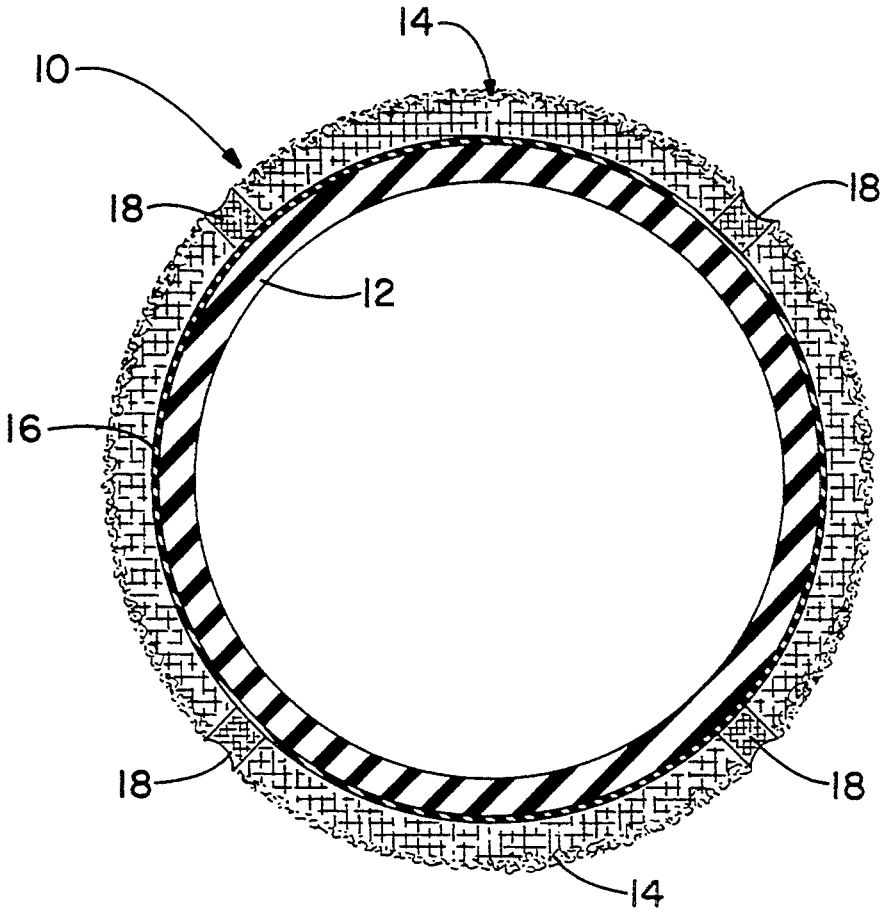
FIG. 1 is a cross-sectional view of a tennis ball showing an elastomeric core, a panel adhesive, felt panels, and a seam adhesive connecting the felt panels.

The preferred embodiment of the present invention relates to a colored elastomer adhesive preferably utilized as a seam adhesive for a tennis ball. Inasmuch as the color of the seam adhesive is preferably the same as the tennis ball panels, there is no need for a contrasting colored elastic band around the tennis ball or the like. The tennis ball 10 has a pressurized or a pressureless hollow elastomeric core 12 which is conventionally made from two hemispheres injection or compression molded from a rubber, such as natural rubber, or synthetic rubber such as those made from conjugated dienes having from 4 to 8 carbon atoms such as butadiene, isoprene, and the like and optionally in association with vinyl substituted aromatic compounds having from 8 to 12 carbon atoms such as styrene, $\alpha$-methyl styrene, and the like. A preferred rubber is natural rubber such as Standard Malaysian Rubber (SMR) such as SMR CV (Viscosity-Stabilized.) The core is subsequently covered by two interconnecting dog-bone shaped felt panels 14. In a preferred method of manufacture, a stack of the felt panels having adhesive on the non-felt side or edge are treated with a colored seam adhesive which later serves to bond together the felt edges of adjacent panels.

The felt used for the panels is a conventional felt made from natural and/or synthetic fibers, for example, a needled nylon and wool felt, which is dyed with any desirable high visibility dye, typically of a yellowish color and preferably a high visibility optic yellow. The adhesive 16 which adheres the panels to the core conventionally comprises natural rubber as an elastomer base.

The yellowish cover can be various shades of yellow, e.g. orange, green etc., with a specific greenish-yellow shade, i.e. optic yellow being preferred. The yellowish color is described by specific color coordinates as measured in the presence of artificial light (i.e. indoor) by Hunter Lab Tristimulus Colorimeter, Model No. D25M-9. The L coordinate of the yellowish panel covers generally ranges from about 70 to about 95, desirably from about 75 to about 90, and preferably from about 81 to about 86. The "a" coordinate is generally from about −10 to about −30, desirably from about −15 to about −27, and preferably from about −20 to about −24, and enhances on the green side of the coordinate scale. The "b" coordinate is generally from about 40 to 60, desirably from about 45 to about 57, and preferably from about 50 to about 54 and enhances on the yellow side of the coordinate scale.

The colored seam adhesive 18 in accordance with the present invention is non-white and thus can contain any colorant but preferably is one or more felt color matching yellowish organic dye and/or pigment systems. The type of organic dyes or pigments utilized include those which improve the visibility of the ball, are color stable, and which abates cosmetic differences. The elastomeric base of this adhesive is a heat curable rubber which is capable of adhering to the core. Typically, natural rubbers and high cis synthetic rubbers (polyisoprene) are preferred, with a particularly suitable example being SMR CV 60, (the number specifies the Mooney viscosity range). This is a high grade natural rubber having a light color and a constant Mooney viscosity. Moreover, SBR rubbers, e.g. emulsion, can be blended with the natural rubbers or utilized in lieu thereof. When utilized, these SBR rubbers should contain at least 50 percent butadiene, preferably at least 60 percent butadiene and most preferably at least about 75 percent butadiene by weight. A key aspect of the seam adhesive rubber is that it have high tack. Peptizers, such as Pepton 44 manufactured by American Cyanamid, an activated dithio-bisbenzanilide, can be used to promote tack and to reduce viscosity of the rubber. The amount of the peptizer is generally from about 0.2 to about 2.0 and preferably from about 0.5 to about 1.5 parts by weight based on 100 parts by weight of rubber.

A curing agent is used which is compatible with the pigment, i.e., it is preferably color stable. By "color stable", it is meant that the color of the cured seam will not substantially change when exposed to artificial light under normal playing conditions. These curing agents are typically either sulfur used at low levels such as from about 0.1 to about 5.0, desirably from about 0.3 to about 3.0, and preferably from about 0.5 to about 1.0 part by weight per hundred of rubber (PHR), or peroxides used at from about 0.5 to about 6.0, desirably from about 1.0 to about 5.0, and preferably from about 1.0 to about 4.0 parts by weight PHR. Low sulfur levels are desired inasmuch as high levels often impart a brown hue to the color seam adhesive due to interaction with the high amount of sulfur in the panel adhesive. Generally, any conventional peroxide can be utilized such as cumene hydroperoxide, dibenzoyl peroxide, diacetyl peroxide, dodecanoyl peroxide, di-t-butyl peroxide, dilauryl peroxide, bis(p-methoxy benzoyl) peroxide, t-butyl peroxy pivalate, dicumyl peroxide, isopropyl percarbonate, and di-sec-butyl peroxidicarbonate with 1,1-bis(t-butyl peroxy) 3,3,5-trimethylcyclohexane and dicumyl peroxide being preferred. In lieu of these curing agents, the adhesive can be cured by using electron beam radiation or thermal systems such as infra-red or microwave radiation.

Antioxidants are generally utilized in small amounts, i.e. up to about 2.0, desirably from about 0.5 to about 1.5 and preferably from about 0.8 to about 1.2 parts by weight PHR. Fillers such as calcium carbonate, magnesium carbonate, titanium dioxide (rutile) talc, mica, various clays, and silica can be used in amounts of from about 1 to about 50, and desirably from about 2 to about 45 parts by weight PHR. Often clear precipitated silica is used because it is transparent. Other processing agents include accelerators, zinc oxide or zinc carbonate, used at from about 0.5 to about 7 and preferably from about 1.0 to about 5.5 parts by weight PHR as a cure activator, and stearic acid at from about 0.25 to about 3 and preferably from about 0.8 to about 1.6 parts by weight PHR to solubilize the zinc oxide.

A preferred aspect of the present invention is to use specific types of organic dyes, e.g. fluorescent, and/or organic pigments which yield a desirable matching yellowish color, preferably optic yellow, and in combination with the seam adhesive is color stable.

Accordingly, one or more organic dyes or pigments are utilized to impart yellowish color to the seam adhesive so that the adhesive is characterized by having the same color coordinates when tested indoors, that is under artificial light, as set forth above with respect to felt panels 14. Thus the L coordinate of the seam adhesive is generally from about 70 to about 95, desirably from about 75 to about 90, and preferably from about 81 to about 86. The "a" coordinate is generally from about −10 to about −30, desirably from about −15 to about −27, and preferably from about −20 to about −24, and enhances on the green side of the coordinate scale. The "b" coordinate is generally from about 40 to 60, desirably from about 45 to 57, and preferably from about 50 to about 54 and enhances the yellow side of the coordinate scale. The preferred coordinates generally define the preferred optic yellow color.

Generally, any pigments and/or dyes can be utilized which achieve substantially the same color as the optic yellow felt cover panels within the above-noted coordinates. Examples of suitable dyes and/or pigments include various quinoline dyes, various azo dyes, various phthalocyanine dyes, and the like.

A preferred combination of colorants utilized to produce a yellow seam adhesive contains a combination of concentrated dyes such as a yellow quinoline dye concentrate component (e.g. TS 44 made by Lauter International) and a phthalocyanine green dye concentrate component (for example, TS 45 also made by Lauter International). Each of these dyes are generally blended with significant amounts of a carrier, such as a terpolymer of formaldehyde, melamine-O-toluenesulfon-amide and p-toluenesulfonamide, CAS No. 30705-14-7. A specific example of a yellow dye, per se, is 1H-Benz{de}isoquinoline-1,3(2H)-dione,6-amino-2-(2,4-dimethylphenyl), CAS number 2478-20-8. In the present invention, the yellowish dye masterbatch contains approximately 1 to 5 parts, preferably from about 2 to about 3 parts by weight of the phthalocyanine green from with about 40 to 60 parts, and preferably from about 45 to about 50 parts by weight, of the yellow dye concentrate and from about 25 to about 75 parts, and preferably from about 40 to about 60 parts, by weight of a polymer carrier such as the above-noted terpolymer. Such a masterbatch is available from Akrochem Corp. as Aerosperse E-7337 Yellow MB. The amount of the optic yellow masterbatch utilized PHR is generally from about 25 to about 50, desirably from about 30 to about 40, and preferably from about 32 to about 36 parts by weight. Although such a yellow colorant system can generally be utilized with any type of rubber cure system, for example, sulfur, peroxide, etc., it is desirably utilized with a peroxide curative.

Another specific blend of organic compounds which can be utilized to yield a seam adhesive cement color substantially the same as the yellowish cover panels is a yellow pigment and a green dye composition. The yellow pigment composition which can be utilized in an amount of about 5 to about 35 and desirably from about 15 to about 25 parts by weight PHR is an azo type pigment masterbatch containing from about 30 to about 60 and preferably from about 40 to about 50 percent by weight of a yellow pigment dispersed in from about 40 to about 70 and preferably from about 50 to about 60 percent by weight of an SBR rubber such as those noted hereinabove. Such a composition is available from a number of manufacturers including Harwick Chemical Corporation under the tradename Stan-Tone 7636 Yellow. The amount of the yellow masterbatch pigment is based upon the amount of rubber in the adhesive formulation other than that in the pigment masterbatch. A suitable example of a yellow pigment is a diarylide with a preferred example being 2,2'-[3,3'-dichloro-4,4'-biphenylylene)bis(azo)]-bis[o-acetoacetanisidide], CAS number 4531-49-1. To impart a green shade to the seam adhesive, a small amount of a green masterbatch, generally from about 2 to about 8 and desirably from about 3 to about 5 parts by weight PHR, is utilized. The suitable green pigment used within the masterbatch include various phthalates such as a diisodecyl phthalate which has the CAS number 68515-49-1. This specific green pigment is often utilized in an amount of from about 10 to about 20 percent by weight of the green masterbatch composition which also contains from about 1 to 5 percent by weight of talc, from about 20 to about 30 percent by weight of HD (high density) chlorinated polyethylene containing from about 20 to about 50 percent by weight of chlorine, from about 0.1 to about 1 percent by weight each of magnesium oxide and stearic fatty acids, and from about 60 to about 70 percent by weight of a chlorinated polyethylene. Such a green pigment masterbatch composition is available as Stan-Tone MR or MC-16654 Green from Hardwick Chemical Corporation. While the above-noted azo-phthalate organic blend can be utilized with any type of cure system, it is preferably utilized with a low amount of sulfur curative.

The total amount of the one or more organic pigments and/or dye masterbatches which can be utilized generally is from about 5 to about 50 PHR, desirably from about 10 to about 45 PHR and preferably from about 20 to about 40 parts by weight PHR.

Although the various pigments, per se, can be added individually to the seam adhesive, they are generally prepared in a masterbatch and then blended with the rubber portion of the adhesive cement and subsequently blended with the above noted fillers, antioxidants, peptides, stearic acid, and the like. Generally all of the components are contained within the seam adhesive formulation with the exception of the cure component, e.g. peroxide or sulfur as well as any accelerators. The cure component is generally blended with the seam adhesive liquid formulation just before the edges of the panel covers are dipped into the fully formulated liquid rubber.

It is further desirable when using fluorescent agents in the seam adhesive to use a transparent rubber base such as the natural rubber and the synthetic isoprene or SBR already mentioned. Zinc carbonate can be used to replace zinc oxide. Preferred fillers include hydrated amorphosilica such as Rubbersil RS 150, magnesium carbonate (Elastocarb) and aluminum silicate.

EXAMPLES

The invention is illustrated further in the following examples which are not to be construed as limiting its scope.

Example 1 relates to a recipe utilizing a phthalocyanine green dye and a quinoline yellow dye contained in a yellow dye masterbatch, i.e, Aerosperse E-7337 yellow (e.g. optic yellow) and is suitable in a peroxide cure formulation.

Example 2 relates to the recipe of a seam adhesive containing a yellow and a green dye to produce a seam adhesive of a color which is substantially the same as the above-noted optic yellow tennis ball panels. This formulation is suitable with low amounts of a sulfur curing agent.

Peroxide Formulation:

| MATERIAL | AMOUNT |
|---|---|
| Natsyn 2200 (Synthetic Cis,1,4-polyisoprene) | 80 parts |
| SBR 1778 Emulsion SBR (23.5% Styrene, 10 Pts. Oil) | 30 parts |
| Elastocarp (Mag Carbonate) | 30 parts |
| Akrochem Zinc 9930 (Trans Zinc Carbonate) | 2 parts |
| Peroximon DC-R (Dicumyl Peroxide) | 2 parts |
| Aerosperse E-7337 Yellow MB containing Quinoline Yellow TS 44 (CAS 2478-20-8) and TS 44 Green | 34 parts |
| Aerosperse E-18016 White MB (80%; $TiO_2$) | 8.5 parts |

The synthetic polyisoprene and the emulsion natural rubber were banded on a mill with the remaining ingredients including the dye masterbatch added thereto and milled at appropriate temperatures and times until the dyes were thoroughly dispersed and produce an optic yellow color. Substantially matching the optic yellow panel color.

Low Sulfur Formulation:

| MATERIAL | AMOUNT |
|---|---|
| SMR CV | 100 parts |
| $TiO_2$ | 36 parts |
| Hi-SIL 223 (Precipitated Silica) | 1 part |
| Zinc Oxide | 3 parts |
| Stearic Acid | 1 part |
| Sulfur | 0.5 parts |
| Wingstay L (antioxidant) | 1 part |
| Pepton 44 (a peptizer) | 1 part |
| Stan-Tone Yellow 7636 Yellow | 20 parts |
| Green Master 16654 | 4 parts |
| Altax (an accelerator) | 1 part |
| ZDMC (an ultra-accelerator) | 1.7 parts |

The 100 parts by weight of rubber was added to a two-roll and banded thereon. Subsequently, the various other ingredients were added, either singly or in combination and milled for sufficient periods of time at suitable temperatures to disperse the various remaining ingredients within the rubber and produce a colored adhesive which substantially matches the optic yellow panel color.

Figure 2:
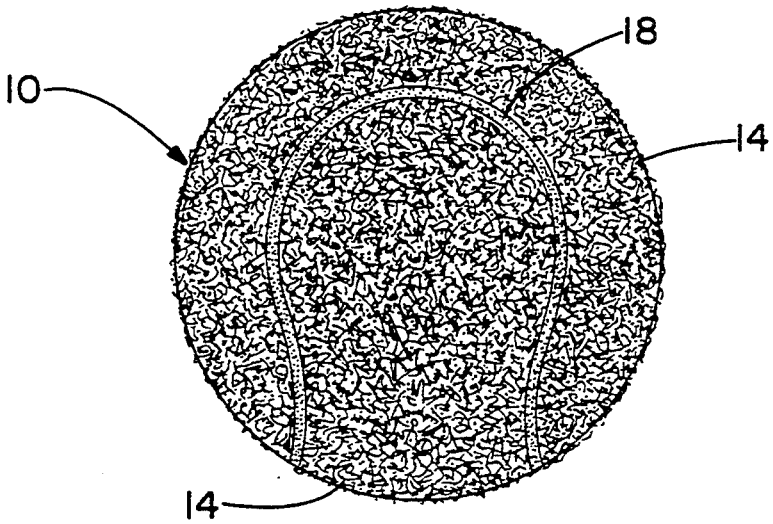
FIG. 2 is a perspective view of the tennis ball wherein the seam adhesive is essentially the same color as the felt panels.

According to the present invention, a tennis ball 10 as shown in FIG. 2 is prepared in the color of preferably the optic yellow felt panels 14 and seam adhesive 18 are substantially the same, regardless of whether a peroxide cure system or a low sulfur cure system were utilized. It is to be understood that seam adhesive color and the felt panel colors are substantially the same when measured by a Hunter Lab stress stimulus colorimeter as noted hereinabove at the time of the manufacturer of the tennis ball, or in artificial light (e.g. indoors), and the like. That is, the seam color essentially matches the yellowish and preferably the optic yellow felt panel cover in the absence of substantial ultraviolet containing light such as sunlight, i.e. direct outdoor sunlight. If exposed to direct sunlight, the sulfur cured seam adhesive will have a slight color change to a yellow-beige, but is substantially, if not completely, reversible (metameric) to the original yellowish color.

While in accordance with the Patent Statutes, the best mode and preferred embodiment has been set forth, the scope of the invention is not limited thereto, but rather by the scope of the attached claims.

What is claimed is:

1. In a ball comprising a hollow elastomeric core having a spherical surface; a pair of dog-bone shaped yellowish felt panels being other than a white color, each said panel having an inner surface and an outer surface and a continuous lateral edge; said inner surface of said panels being adhered to a portion of said spherical surface by an elastomeric panel adhesive; said panels having juxtaposed lateral edges which are continuously joined to each other by an elastomeric rubber-containing seam adhesive and said seam adhesive being cured to form a seam which adheres to said elastomeric core, said seam and said panels forming a cover for said elastomeric core; the improvement comprising a non-white seam having an effective amount of one or more organic colorants so that said seam is substantially the same yellowish color as said panels.

2. In a ball according to claim 1, wherein said ball is a tennis ball, and wherein said organic colorant contains at least one organic pigment, or at least one organic dye, or combinations thereof.

3. In a tennis ball according to claim 2, wherein said seam adhesive has a Hunter L color coordinate of from about 70 to about 95, an "a" coordinate from about −10 to about −30 and a "b" coordinate from about 40 to about 60, and wherein said panel color has the same color coordinates.

4. In a tennis ball according to claim 2, wherein said seam adhesive has a Hunter L coordinate of from 75 to about 90, an "a" coordinate from about −15 to about −27 and a "b" coordinate from about 45 to about 57, and wherein said panel color has the same color coordinates.

5. In a tennis ball according to claim 2, wherein said seam adhesive has a Hunter L coordinate of from about 81 to about 86, a "a" coordinate from about −20 to about −24 and a "b" coordinate from about 50 to about 54, and wherein said panel color has the same color coordinates.

6. In a tennis ball according to claim 2, wherein said seam adhesive is cured with from about 0.1 to about 5 parts by weight of sulfur per 100 parts by weight of said elastomer.

7. In a tennis ball according to claim 3, wherein said seam adhesive is cured with from about 0.3 to about 3 parts by weight of sulfur per 100 parts by weight of said elastomer.

8. In a tennis ball according to claim 5, wherein said seam adhesive is cured with from about 0.1 to about 1.0 parts by weight of sulfur per 100 parts by weight of said elastomer.

9. In a tennis ball according to claim 8, wherein said colorant is a blend of diisodecyl phthalate and 2,2'-[(3,3'-Dichloro-4,4'-biphenylylene)bis(azo)]bis[o-acetoacetanisidide].

10. In a tennis ball according to claim 2, wherein said seam adhesive is cured with from about 0.5 to about 6 parts by weight of an organic peroxide per 100 parts by weight of said elastomer rubber.

11. In a tennis ball according to claim 5, wherein said seam adhesive is cured with from about 1 to about 4 parts by weight of an organic peroxide per 100 parts by weight of said elastomer rubber.

12. In a tennis ball according to claim 11, wherein said colorant is a blend of phthalocyanine green and 1H-Benz{de}isoquinoline-1,3(2H)-dione,6-amino-2-(2,4-dimethylphenyl).

* * * * *